US006113441A

United States Patent [19]

Fukase et al.

[11] Patent Number: 6,113,441

[45] Date of Patent: Sep. 5, 2000

[54] METAL TERMINAL AND WIRE CONNECTOR

[75] Inventors: Yoshihiro Fukase; Toshihiro Maki, both of Shizuoka, Japan

[73] Assignee: Yazaki Corporation, Tokyo, Japan

[21] Appl. No.: 09/148,188

[22] Filed: Sep. 4, 1998

[30] Foreign Application Priority Data

Apr. 9, 1997 [JP] Japan ..... 8-239567

[51] Int. Cl.[7] ..... H01R 4/10

[52] U.S. Cl. ..... 439/877

[58] Field of Search ..... 439/488, 489, 439/491, 877, 878, 884, 888

[56] References Cited

U.S. PATENT DOCUMENTS 5,487,686 1/1996 Sawada ..... 439/884
5,533,914 7/1996 Sawada ..... 439/843

FOREIGN PATENT DOCUMENTS 9-161938 6/1997 Japan ..... H01R 43/048

*Primary Examiner*—Brian Sircus
*Assistant Examiner*—Eugene G. Byrd
*Attorney, Agent, or Firm*—Sughrue, Mion, Zinn, Macpeak & Seas, PLLC

[57] ABSTRACT

A method of determining whether a metal terminal including a conductor clamping section for clamping a wire thereto is satisfactorily connected to the wire or not, the method includes steps of: providing a first metal terminal including a first conductor clamping section for clamping a first wire thereto; calculating one of dimensional variation and a rate of a dimensional change of the first conductor clamping section in an axial direction of the first metal terminal are caused before and after clamping the first conductor clamping section; and preparing compressibility comparison data by calculating, from a section of the first conductor clamping section after clamping the first conductor clamping section, compressibility of the first wire with respect to the first conductor clamping section based on the one of the dimensional variation and the rate of the dimensional change. In the method, after preparing the compressibility comparison data, a second metal terminal including a second conductor clamping section for clamping a second wire is provided, and one of dimensional variation and a rate of a dimensional change in distance between marks applied along formation reference positions on the second conductor clamping section is calculated and is compared with the compressibility comparison data, thereby determining whether or not the second metal terminal is satisfactorily connected to the second wire. Furthermore, each width of the marks is made equal to range of dimensional tolerance of each of the bellmouths in the formation thereof. Therefore, whether state of the formation of bellmouths is acceptable or not can be determined by detecting positions of base end portions of the bellmouths.

6 Claims, 5 Drawing Sheets

METAL TERMINAL AND WIRE CONNECTOR

BACKGROUND OF THE INVENTION

1. Field of the Invention

This invention relates to a method of determining whether or not a conductor clamping section of a metal terminal is satisfactorily connected to a wire, and also relates to the metal terminal.

The present application is based on Japanese Patent Application No. Hei. 9-239567, which is incorporated herein by reference.

2. Description of the Related Art

A metal terminal includes an electrical contact section having a predetermined configuration, and a wire connecting section having a conductor clamping section which is connected to a wire by pressure contact. Before conducting the pressure contact, first the wire is cut to a predetermined length, and then an insulating sheath at an end portion of the wire is removed.

When the metal terminal is connected to a conductor of the wire by the pressure contact, the metal terminal must be electrically connected completely to the wire, and must have a holding force which is equivalent to the tensile strength of the wire. That is, the pressure contact of the metal terminal to the wire must be high both in electrical characteristic and mechanical characteristic.

If the pressure contact is not sufficient, a gap may be formed between the conductor clamping section of the metal terminal and the conductor of the wire. In this case, since the holding force by the conductor clamping section is small, the conductor of the wire may easily come off the metal terminal.

At a site of production, for the purpose of quality control, there may be a case in that a conductor clamping section of a metal terminal by which a conductor of a wire is clamped is cut across the axis of the terminal, and from the resultant section the compressibility of the wire with respect to the conductor clamping section is calculated. Based on the compressibility as one yardstick, state of the connection between the metal terminal and the wire is determined.

On the other hand, when the metal terminal is connected to the wire by the pressure contact, wire breakage preventing bellmouths are formed on both end portions of the conductor clamping section in an axial direction of the terminal so as to hem the both end portions. Similar to the above-described site of production, for the purpose of quality control, the width of the bellmouths in the axial direction of the terminal may be periodically measured in order to determine the state of formation of the conductor clamping section.

In the above-described structure, a troublesome operation may be carried out. That is, whenever the state of the connection between the metal terminal and the wire is determined, the conductor clamping section must be cut to examine the compressibility of the wire with respect to the conductor clamping section. If the aforementioned operation must take a long time, the productivity of the manufacture is lowered.

Further, in the dimensional inspection of the bellmouths, since the bellmouths are extremely small, measurement of the dimension of the bellmouths may be troublesome. Therefore, such measurement is liable to occur an error, and similarly to the above-described case, the productivity of the manufacture is lowered. In addition, the connection of the wire is not sufficiently high in reliability.

SUMMARY OF THE INVENTION

In order to eliminate the above-described problems, an object of the present invention is to provide a method of determining whether or not a metal terminal is satisfactorily connected to a wire in which whether the wire is satisfactorily connected to a conductor clamping section of the metal terminal or not and whether state of formation of wire breakage preventing bellmouths is acceptable or not are readily determined, and in the manufacture the productivity and the reliability in quality control are markedly improved.

To achieve the above object, according to the first aspect of the present invention, there is provided a method of determining whether a metal terminal including a conductor clamping section for clamping a wire thereto is satisfactorily connected to the wire or not, the method which comprises steps of: providing a first metal terminal including a first conductor clamping section for clamping a first wire thereto; calculating one of dimensional variation and a rate of a dimensional change of the first conductor clamping section in an axial direction of the first metal terminal are caused before and after clamping the first conductor clamping section; preparing compressibility comparison data by calculating, from a section of the first conductor clamping section after clamping the first conductor clamping section, compressibility of the first wire with respect to the first conductor clamping section based on the one of the dimensional variation and the rate of the dimensional change; providing a second metal terminal including a second conductor clamping section for clamping a second wire; and determining whether the second metal terminal is satisfactorily connected to the second wire or not by comparing one of dimensional variation and a rate of a dimensional change of the second conductor clamping section with the compressibility comparison data. According to the first aspect of the present invention, after preparing a compressibility comparison data, for example, for quality control, dimensional variation or a rate of a dimensional change of a conductor clamping section can be easily periodically calculated and compared with the compressibility comparison data. Accordingly, whether the conductor clamping section is satisfactorily connected to the wire or not can be readily determined. In addition, in the manufacture, the productivity, and the reliability in quality control are markedly improved.

Further, according to the second aspect of the present invention, the method of the first aspect of the present invention further comprises a step of applying a connection state determining beltshaped mark to each of the first conductor clamping section and the second conductor clamping section before clamping them; wherein, in the step of calculating, the one of the dimensional variation and the rate of the dimensional change of the first conductor clamping section is calculated based on a change in width of the mark caused before and after clamping the first conductor clamping section, and wherein, in the step of determining, the one of the dimensional variation and the rate of the dimensional change of the second conductor clamping section is compared with the compressibility comparison data. Therefore, if the width of the mark is constant, measurement of dimension about the calculation of the dimensional variation or the rate of the dimensional change is simplified. That is, whether the conductor clamping section is satisfactorily connected to the wire or not can be more readily determined. Accordingly, in the manufacture, the productivity and the quality control are markedly improved.

Further, according to the third aspect of the present invention, the method of the first aspect of the present invention further comprises a step of applying a pair of connection state determining belt-shaped marks to each of the first conductor clamping section and the second conductor clamping section before clamping them such that the belt-shaped marks are confronted with each other; wherein, in the step of calculating, the one of the dimensional variation and the rate of the dimensional change of the first conductor clamping section is calculated based on a change in distance between the marks caused before and after clamping the first conductor clamping section, and wherein, in the step of determining, the one of the dimensional variation and the rate of the dimensional change of the second conductor clamping section is compared with the compressibility comparison data. Therefore, if the distance between the pair of the belt-shaped marks is constant, measurement of dimension about the calculation of the dimensional variation or the rate of the dimensional change is simplified. That is, whether the conductor clamping section is satisfactorily connected to the wire or not can be more readily determined. Accordingly, in the manufacture, the productivity and the quality control are markedly improved.

Further, according to the fourth aspect of the present invention, in the method of the third aspect of the present invention, the marks are respectively applied along formation reference positions of wire breakage preventing bellmouths which are formed on both end portions of each of the first conductor clamping section and the second conductor clamping section by clamping each of the first conductor clamping section and the second conductor clamping section, and the method further comprises a step of determining whether state of formation of the bellmouths is acceptable or not by comparing the respective marks with respective positions of the bellmouths. In addition to the effect of the third aspect of the present invention, the fourth aspect of the present invention provides effects in that whether or not the state of formation of the bellmouth is acceptable can be determined, and in the manufacture, the productivity and the reliability in quality control is markedly improved.

Furthermore, according to the fifth aspect of the present invention, there is provided a terminal which comprises: an electrically conductive plate including a conductor clamping section to which a wire is connectable; and at least one belt-shaped mark applied to the conductor clamping section. In the terminal, the belt-shaped mark is for determining whether the wire is satisfactorily connected to the terminal or not, after one of dimensional variation and a rate of a dimensional change caused before and after clamping the conductor clamping section is calculated. Accordingly, if the dimensional variation or the rate of the dimensional change in an axial direction of the terminal before and after clamping the conductor clamping section is calculated, and the compressibility comparison data is prepared by calculating compressibility of the wire with respect to the conductor clamping section based on the one of the dimensional variation and the rate of the dimensional change, then whether or not the conductor clamping section is satisfactorily connected to the wire can be readily determined by comparing the dimensional variation or the rate of the dimensional change of the mark with the compressibility comparison data. Accordingly, in the manufacture, the productivity and the reliability in quality control are markedly improved.

Further, according to the sixth aspect of the present invention, in the terminal of the fifth aspect of the present invention, a plurality of the belt-shaped marks are applied along formation reference positions of wire breakage preventing bellmouths which are formed on both end portions of the conductor clamping section after the conductor clamping section is clamped. Accordingly, whether the conductor clamping section is satisfactorily connected to the wire or not and whether the state of formation of the wire breakage preventing bellmouth is acceptable or not can be determined.

Further, according to the seventh aspect of the present invention, in the terminal of the sixth aspect of the present invention, each width of the marks is equal to range of dimensional tolerance of each of the bellmouths. Accordingly, the state of formation of the bellmouth can be determined visually depending on the position of the end of the bellmouth with respect to the mark after clamping the conductor clamping section.

BRIEF DESCRIPTION OF THE DRAWINGS

FIG. 4).

DETAILED DESCRIPTION OF THE PREFERRED EMBODIMENTS

A preferred embodiment of the present invention will be described with reference to FIGS. 1 to 8.

Figure 1:
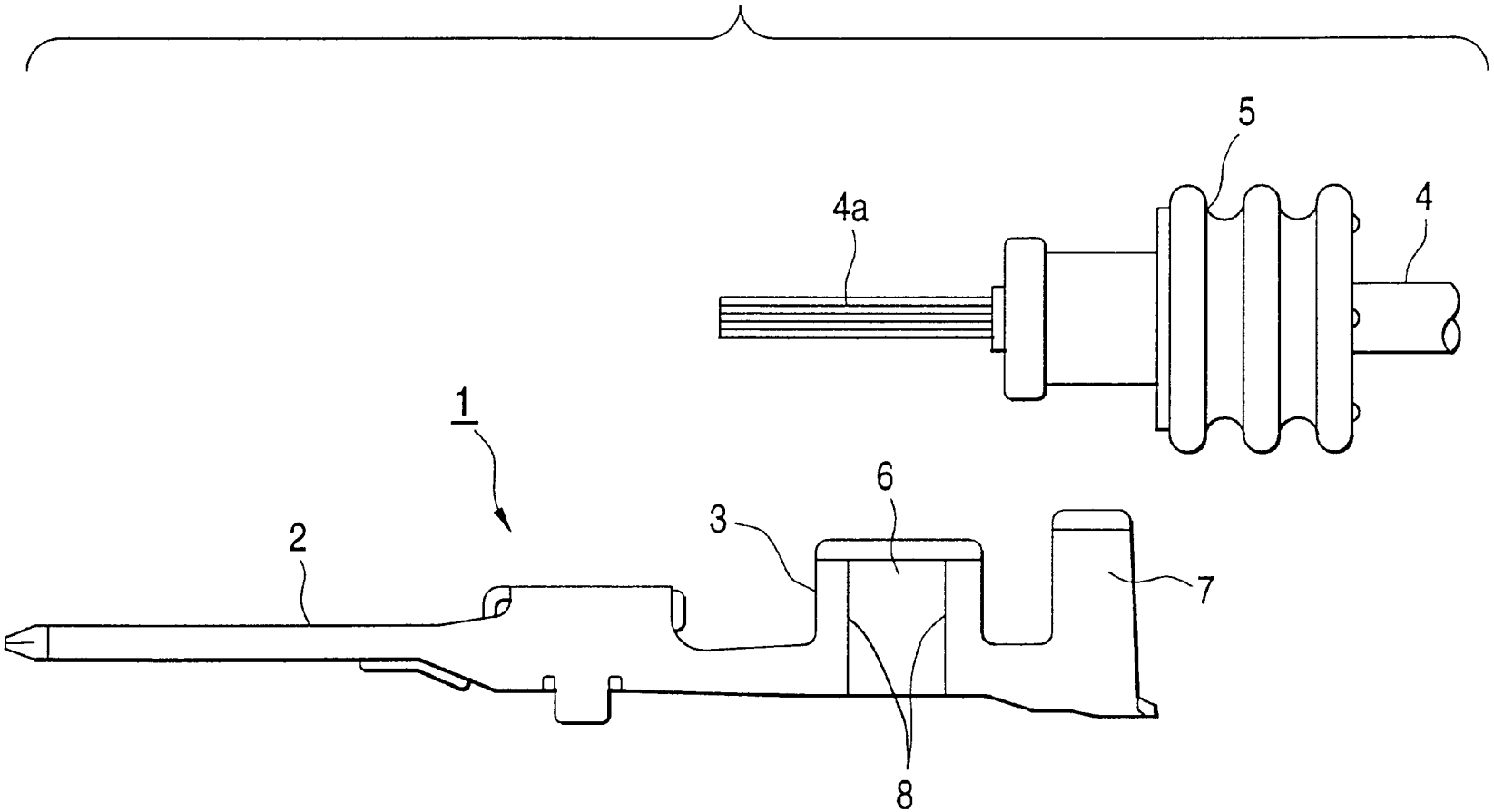
FIG. 1 is a diagram showing a method of determining state of connection of a metal terminal and a wire, and a metal terminal.

In FIG. 1, reference numeral 1 designates a metal terminal. The metal terminal 1 has a male type electrical contact section 2, and a wire connecting section 3. The metal terminal 1 is formed by pressing an electrically conductive plate such as a copper plate a copper alloy plate (e.g. a brass plate and beryllium-copper alloy plate). Reference numeral 4 denotes a wire. The insulating sheath is removed from the end portion of the wire 4 to expose a conductor 4*a*. After removing the insulating sheath, a rubber plug 5 is mounted.

The electrical contact section 2 is so designed that the electrically conductive plate is folded over to obtain a predetermined mechanical strength and a desired thickness. The wire connecting section 3 has a pair of conductor clamping sections 6, and a pair of insulating sheath clamping sections 7.

Figure 2:
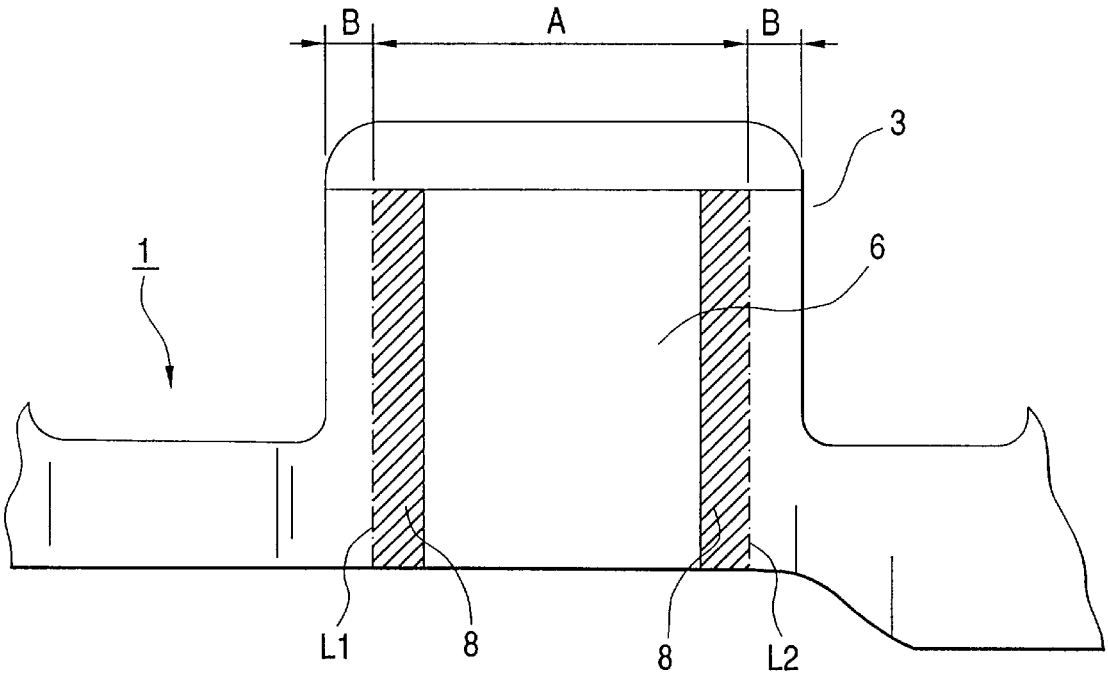
FIG. 2 is an enlarged diagram showing a conductor clamping section of the mental terminal shown in FIG. 1.

In FIG. 2, the conductor clamping section 6 is divided as follows: A region between phantom lines L1 and L2 is a clamping region A which is clamped with a pressing member 11 shown in FIG. 3. Regions located outside the clamping region A are bellmouth forming regions B and B for bellmouths 9 and 9 (cf. FIG. 4) which prevent breakage of the conductor 4*a*.

A pair of connecting state determining beltshaped marks 8 and 8 are applied to the clamping region A with paint or the like inside the phantom lines L1 and L2 as reference lines. Each width of the marks 8 and 8 is equal to range of dimensional tolerance of each of the bellmouths 9 and 9.

Figure 3:
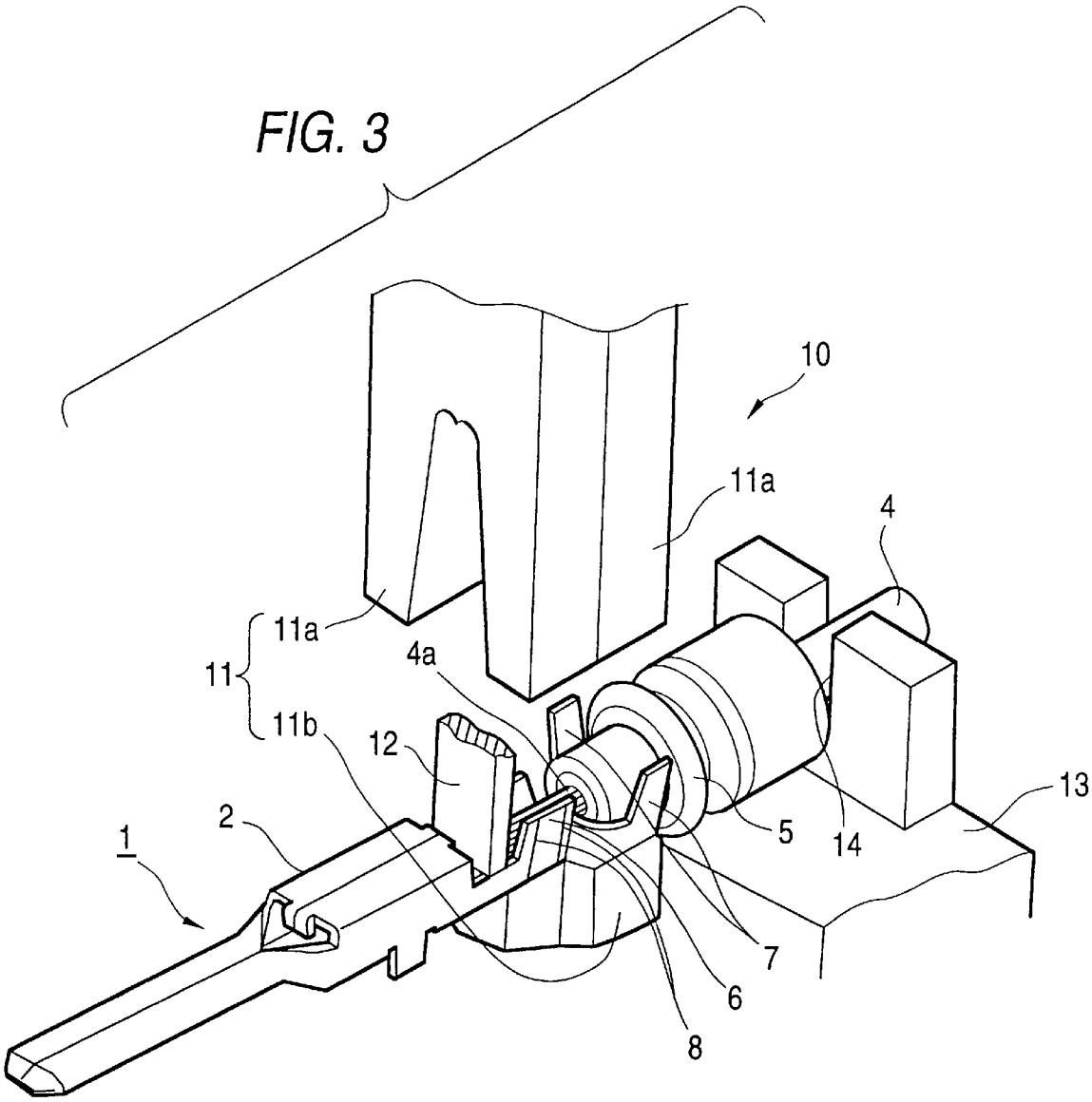
FIG. 3 is a perspective view for a description of a process of connecting the metal terminal to the wire by pressure contact shown in FIG. 1.

A process of connecting the metal terminal 1 to the wire 4 by pressure contact will be described with reference to FIG. 3. In FIG. 3, reference numeral 10 designates a terminal pressing device; 11, a pressing member comprising a clamping mold 11*a* and a receiving section 11*b;* 12, a wire/terminal positioning member; and 13, a rubber plug positioning member having a positioning groove 14.

The metal terminal 1 is set in the receiving section 11*b,* and the wire/terminal positioning member 12 is downwardly moved to the metal terminal 1. Then, the wire 4 is mounted on the metal terminal so that the conductor 4*a* abuts against the wire/terminal positioning member 12. Further, the rubber plug 5 is positioned with the rubber plug positioning member 13, and the rear end portion of the wire 4 is fitted in the positioning groove 14. Under this condition, the clamping mold lla of the pressing member 11 is downwardly moved so that the conductor clamping section 6 and the insulating sheath clamping section 7 are plastically deformed, whereby the metal terminal 1 is fixedly connected to the wire 4.

Figure 4:
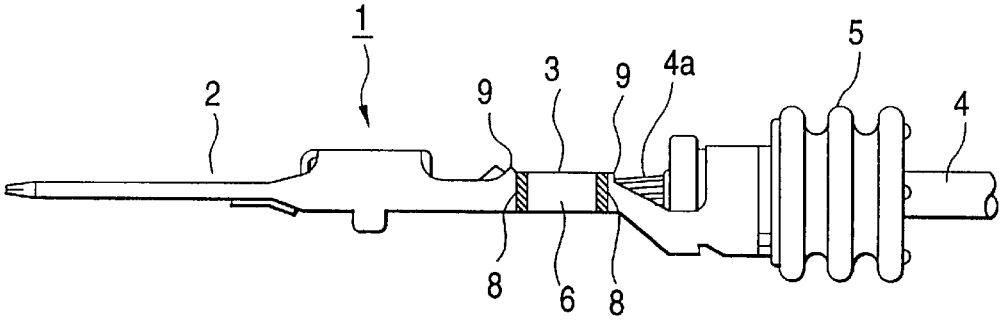
FIG. 4 is a front view of the metal terminal which is connected to the wire together with a rubber plug according to the process shown in FIG. 3.

Accordingly, as shown in FIG. 4, the wire 4 together with the rubber plug 5 is connected to the metal terminal 1. The clamping mold 11*a* (cf. FIG. 3) presses the clamping region A (cf. FIG. 2) of the conductor clamping section 6. After clamping, the bellmouths 9 and 9 are formed on the both end portions of the conductor clamping section 6 in the axial direction of the terminal 1 with the phantom lines L1 and L2 as formation reference positions. The bellmouths 9 and 9 should hem the both end portions of the conductor clamping section 6 in accordance with the bellmouth forming regions B and B (cf. FIG. 2) so as to eliminate a problem in that the conductor 4*a* is cut by both edges of the conductor clamping section 6 during the clamping operation.

Figure 5:
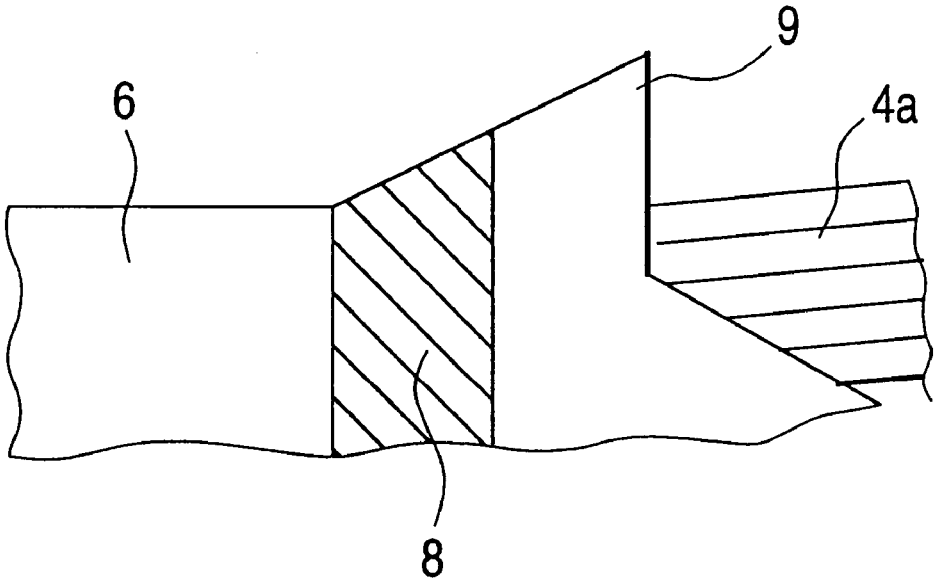
FIG. 5 is an enlarged diagram showing a bellmouth which is formed on a conductor clamping section at the upper limit of the dimensional tolerance.
Figure 6:
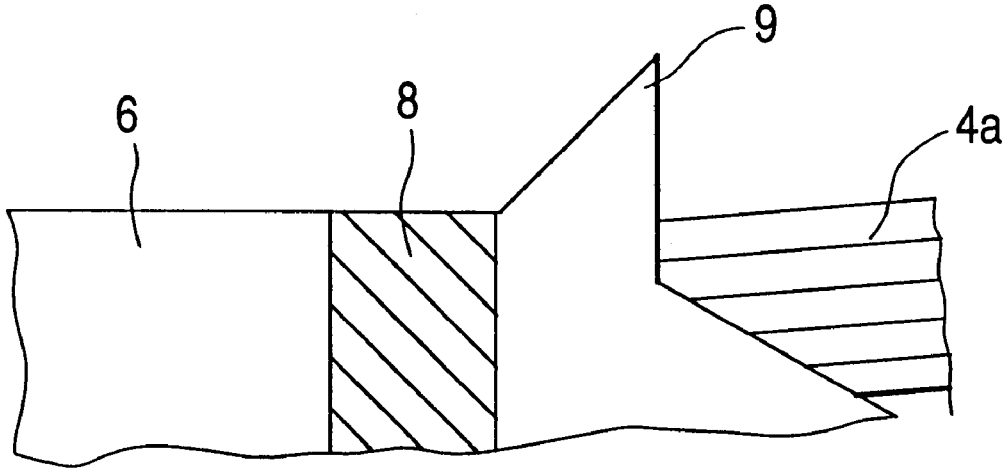
FIG. 6 is an enlarged diagram showing a bellmouth which is formed on the conductor clamping section at the lower limit of the dimensional tolerance.

A method of determining whether state of formation of bellmouths is acceptable or not, will be described with reference to FIGS. 5 and 6.

When base end portions of the bellmouths 9 are more shifted towards the middle of the conductor clamping section 6 than the formation reference positions (i.e., the phantom lines L1 and L2), the marks 8 respectively come onto the base end portions of the bellmouths 9 because the marks 8 have width corresponding to range of the dimensional tolerance of the bellmouths 9. When the bellmouths 9 are formed at the upper limit of the dimensional tolerance thereof, all of the marks 8 come onto the bellmouths 9 as shown in FIG. 5. Accordingly, the state of the bellmouths 9 can be detected such that the bellmouths 9 are formed at the upper limit of the dimensional tolerance thereof. On the other hand, when the bellmouths 9 are formed at the lower limit of the dimensional tolerance thereof as shown in FIG. 6, the base end portions of the bellmouths 9 respectively coincide with the end portions of the marks 8 (i.e., the aforementioned formation reference positions). Accordingly, the state of the bellmouths 9 can be visually determined from the positions of the base end portions of the bellmouths 9 whether the bellmouths 9 are formed at predetermined dimensions or not.

Next, a method of determining whether or not the metal terminal 1 is satisfactorily connected to the wire 4, will be described.

Figure 7:
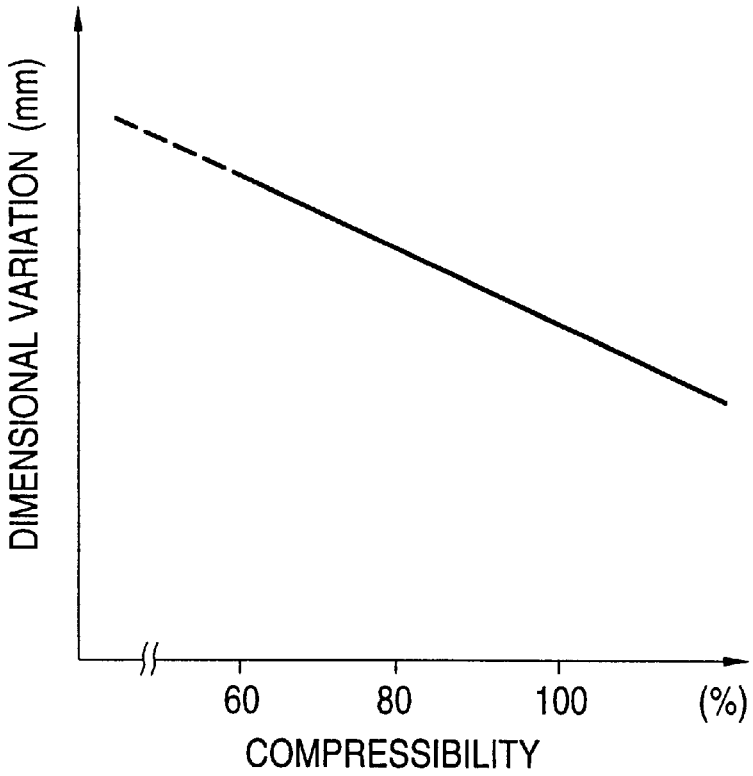
FIG. 7 is a graphical representation indicating compressibility with conductor clamping section dimensional variation.

When the conductor clamping section 6 is clamped, it extends in an axial direction of a terminal. More specifically, variation of the dimension of the conductor clamping section 6 is caused before and after clamping the conductor clamping section 6. The method utilizes this extension. First, a plurality of patterns of the variation of the dimension of the conductor clamping section 6 are previously sampled as dimensional variation or a rate of a dimensional change. Per every pattern, the clamped conductor clamping section 6 is cut in a direction perpendicular to the axis of the terminal, and the section is utilized to obtain the compressibility of the wire 4 with respect to the conductor clamping section 6. Based on the foregoing, for example, compressibility comparison data as shown in FIG. 7 is prepared; that is, a graph of compressibility with dimensional variation is formed.

Thereafter, periodically or when necessary, a distance between marks 8 and 8 may be measured with a conventional measuring apparatus such as a sensor. That is, from a next metal terminal 1, based on a dimensional variation or a rate of a dimensional change of a conductor clamping section 6 of the metal terminal 1, compressibility of a wire 4 with respect to the conductor clamping section 6 is examined from the graph of FIG. 7. In this case, whether the state of the connection between the metal terminal 1 and the wire 4 is satisfactory or not can be readily determined. Accordingly, this method can eliminate the problem accompanying the aforementioned related art.

Figure 8:
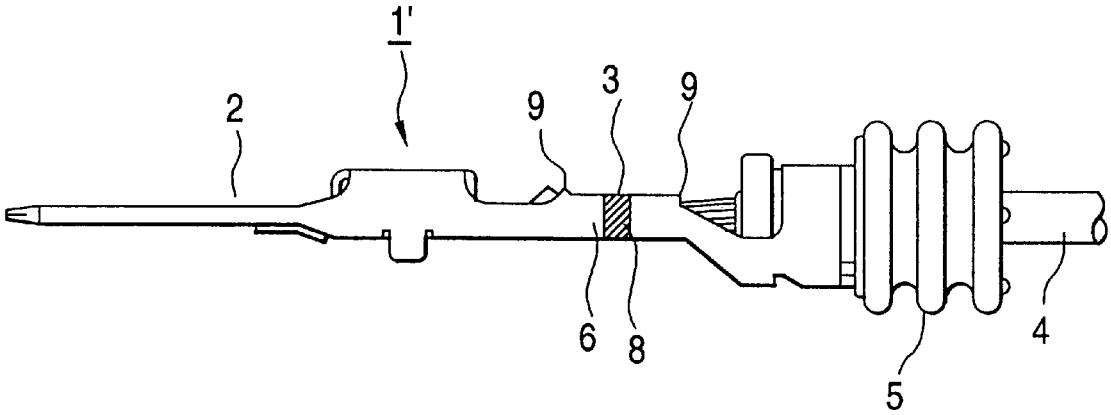
FIG. 8 is a front diagram showing another example of the position of the connecting state determining belt-shaped mark (cf.

The above-described embodiment is to easily achieve the determination of whether the bellmouths 9 are acceptable in configuration or not and whether the metal terminal 1 is satisfactorily connected to the wire 4 or not. Additionally, in the embodiment, the pair of connecting state determining belt-shaped marks 8 and 8 are applied to the conductor clamping section 6 as an example. However, if the object were only to determine whether the state of the connection between the metal terminal 1 and the wire 4 is satisfactory or not, then only one mark might be applied to the metal terminal 1. FIG. 8 shows such modification. As shown in FIG. 8, a mark 8' having a predetermined width is applied on the middle of the conductor clamping section 6 of a metal terminal 1'. In this case, after clamping the conductor clamping section 6, the width of the mark 8' is measured, and is compared with the aforementioned compressibility comparison data. Accordingly, whether the metal terminal 1' is satisfactorily connected to the wire 4 or not can be readily determined.

Although the metal terminal 1 or 1' having the male type electrical contact section 2 has been described, the electrical contact section is not limited to the male type. That is, the technical concept of the present invention is applicable to metal terminals of a variety of types. A feature of the present invention resides in the conductor clamping section which is clamped to connect a metal terminal to a wire. Hence, the technical concept of the present invention is applicable to other structures having a conductor clamping section.

What is claimed is:

1. A terminal, comprising:

an electrically conductive member including a conductor clamping section to which a wire is connectable; and at least one belt-shaped mark applied to the conductor clamping section, the dimensions of said mark changing upon clamping of said clamping section providing an indication of a degree of compression of the wire.

2. The terminal of claim 1, wherein a width of the belt-shaped mark changes upon clamping said clamping section to the wire such that a determination of whether the wire is satisfactorily connected to the terminal can be made by calculating one of the dimensional variation and a rate of a dimensional change in an axial direction of the terminal caused by the clamping of the conductor clamping section.

3. The terminal of claim 1, wherein a plurality of the belt-shaped marks are applied along formation reference positions of wire breakage preventing bellmouths which are formed on both end portions of the conductor clamping section after the conductor clamping section is clamped.

4. The terminal of claim 3, wherein each width of the belt-shaped marks is equal to a range of dimensional tolerance of each of the bellmouths.

5. The terminal of claim 1, wherein said belt-shaped mark is applied to an exterior surface of the conductor clamping section.

6. The terminal of claim 2, wherein said belt-shaped mark extends in a direction transverse to said axial direction.

* * * * *